US006612221B1

(12) United States Patent
Röllgårdh

(10) Patent No.: US 6,612,221 B1
(45) Date of Patent: Sep. 2, 2003

(54) PISTON-CYLINDER DEVICE WITH PISTON ROD LOCKING MEANS

(75) Inventor: Folke Lennart Röllgårdh, Dannike (SE)

(73) Assignee: Parker Hannifin AB, Boras (SE)

( * ) Notice: Subject to any disclaimer, the term of this patent is extended or adjusted under 35 U.S.C. 154(b) by 0 days.

(21) Appl. No.: 09/937,798

(22) PCT Filed: Mar. 24, 2000

(86) PCT No.: PCT/SE00/00579

§ 371 (c)(1),
(2), (4) Date: Jan. 30, 2002

(87) PCT Pub. No.: WO00/58632

PCT Pub. Date: Oct. 5, 2000

(30) Foreign Application Priority Data

Mar. 26, 1999 (SE) ..... 9901108

(51) Int. Cl.[7] ..... F15B 15/26
(52) U.S. Cl. ..... 92/21 MR; 92/23; 92/28
(58) Field of Search ..... 92/20, 21 R, 21 MR, 92/23, 24, 25, 28

(56) References Cited

U.S. PATENT DOCUMENTS 3,918,346 A * 11/1975 Ziegler ..... 92/28
4,214,795 A * 7/1980 Kakuminato ..... 92/25
5,553,690 A * 9/1996 Takahashi ..... 188/300
5,761,984 A 6/1998 Goellner et al.
6,044,934 A * 4/2000 Nemeth ..... 92/25
6,178,870 B1 * 1/2001 Takahashi ..... 92/28
6,343,538 B1 * 2/2002 Skinner ..... 92/23

FOREIGN PATENT DOCUMENTS

EP 0103555 A1 3/1984
GB 997815 A 7/1965

* cited by examiner

*Primary Examiner*—Edward K. Look
*Assistant Examiner*—Thomas E. Lazo
(74) *Attorney, Agent, or Firm*—Frishauf, Holtz, Goodman & Chick, P.C.

(57) ABSTRACT

A pressure medium activated piston-cylinder device comprises a cylinder with two end walls both having pressure medium communication ports, a piston movably guided in the cylinder and connected to a piston rod which extends out of the cylinder through a sealed-off passageway in a first one of the end walls, and a piston rod locking device located in the passageway and including a clamping element axially locked to the first end wall, and an activating member which is continuously spring biased toward a clamping element activating position and shiftable by pressure medium toward a release position, against the spring bias force, wherein a manually operable release mechanism comprises a tubular thrust element movable in the first end wall between a rest position and an activating member releasing position, and a maneuver spindle having a cam surface for co-operation with a cam surface on the thrust element for moving the thrust element between its rest position and the activating member releasing position as the maneuver spindle is rotated.

6 Claims, 2 Drawing Sheets

PISTON-CYLINDER DEVICE WITH PISTON ROD LOCKING MEANS

The invention relates toga pressure medium activated piston-cylinder device including a cylinder with two end walls having pressure medium communication ports, a piston movably guided in the cylinder and connected to a piston rod which extends out of the cylinder through a sealed-off passageway in a first one of the end walls, a piston rod locking device located in the passageway and including at least one piston rod engaging clamping element which is axially locked relative to the first end wall, and an activating member continuously spring biassed toward a clamping element activating position and shiftable by pressure medium toward a release position against said spring bias as pressure medium is supplied to the cylinder via either one of the communication ports.

Piston-cylinder devices of this type are previously well known for various applications, See for instance U.S. Pat. No. 5,761,984, GB 997,815 and EP 103 555. They all suffer from a drawback relating to their pressure medium released piston rod locking mechanisms which lock automatically the piston rod and the object connected thereto in the very position occupied at the moment the medium pressure is interrupted. The drawback resides in the fact that there is no possibility to move manually the piston rod and the connected object without pressure medium being available. This may be particularly serious in some emergency cases where the connected object has to be moved immediately.

The primary object of the invention is to provide a piston-cylinder device of the above described type, wherein the piston rod locking device is releasable by means of a manually operable release mechanism.

Another object of the invention is to provide a piston-cylinder device of the above related type with a manually operable release mechanism which is simple and compact in design and which does not add considerably to the outer dimensions of the device.

A further object of the invention is to provide a piston-cylinder device of the above type wherein a manually operable release mechanism is designed so as to be easily operable by a low manual force.

Further objects and advantages of the invention will appear from the following specification in which is described in further detail and with reference to the accompanying drawings a preferred embodiment of the invention.

ON THE DRAWINGS

Figure 1:
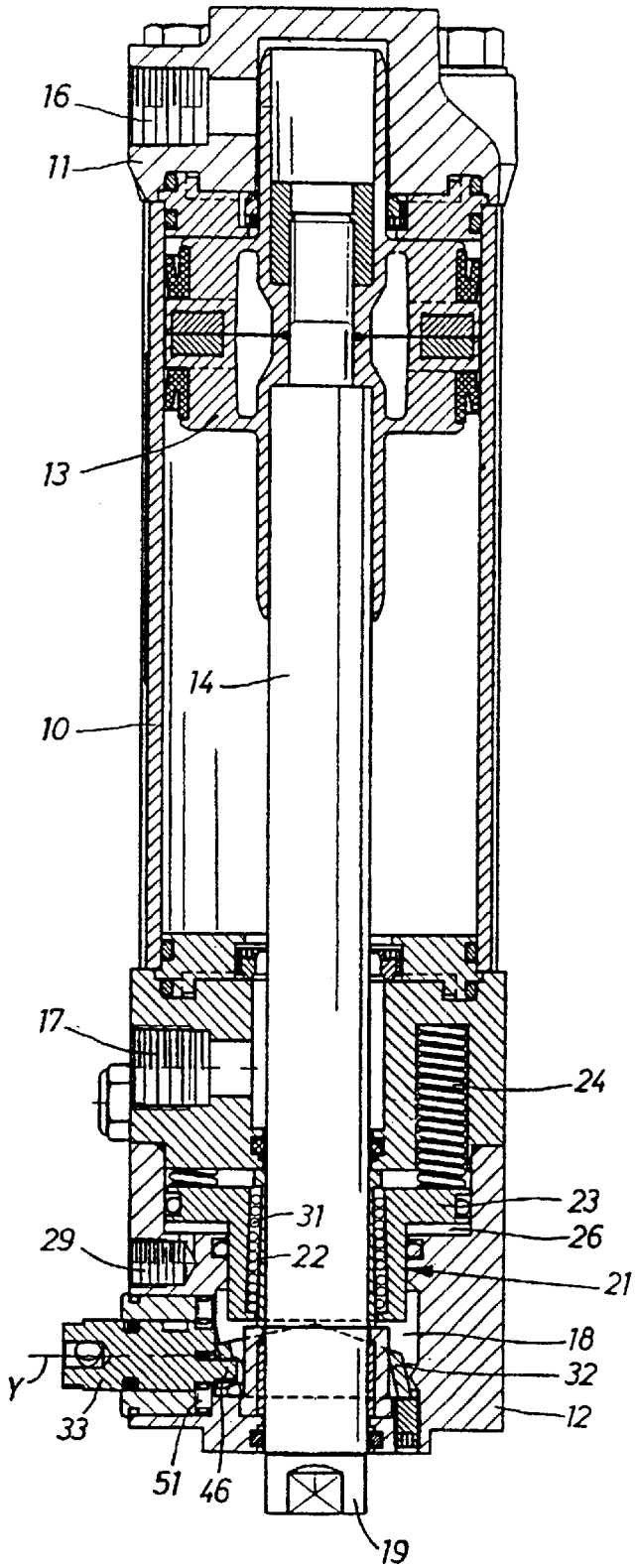
FIG. 1 shows a longitudinal section through a piston-cylinder device according to the invention.

The piston-cylinder device illustrated in the drawings comprises basically a cylinder 10 with two end walls 11,12, and a piston 13 movably guided in the cylinder 10 and connected to a piston rod 14. Both of the cylinder end walls 11,12 are provided with.pressure medium communication ports 16,17 which are connected to a pressure medium control circuit (not shown) for supplying and draining pressure medium to and from the cylinder, respectively, thereby accomplishing movement of the piston 13 in the cylinder 10.

One of the end walls 12 is formed with an axially extending passageway 18 through which the piston rod 14 extends out of the cylinder 10. At its outer end the piston rod 14 is provided with a connection means 19 for connection to an object to be operated by the device.

Figure 2:
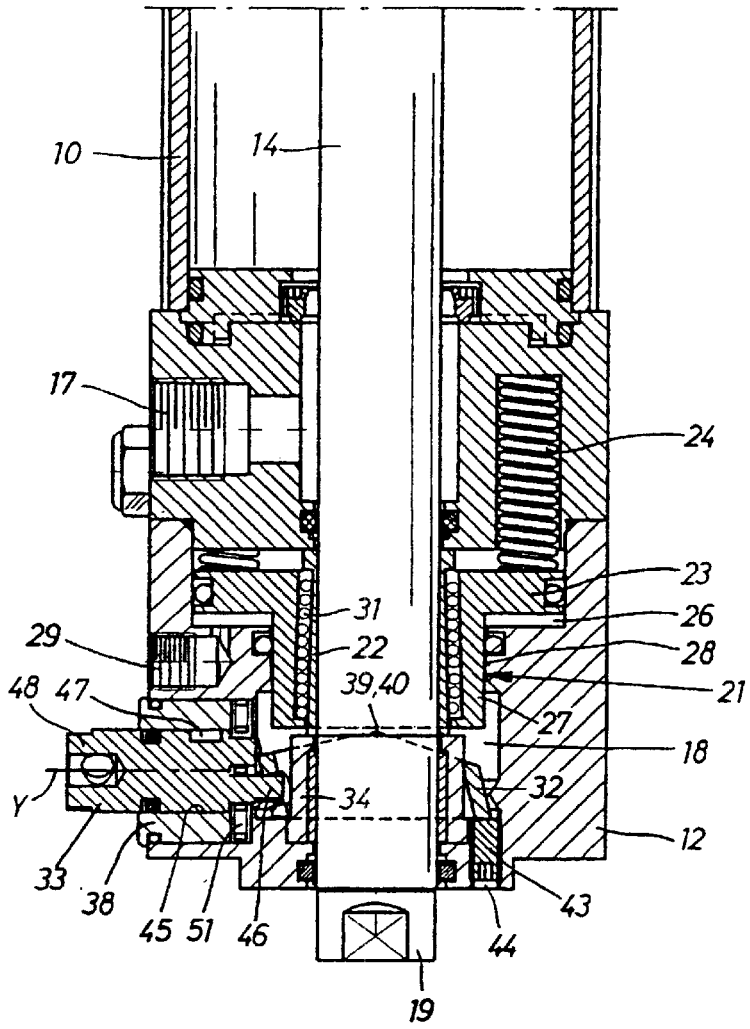
FIG. 2 shows, on a larger scale, a longitudinal section through one of the cylinder end walls including the piston rod locking device.
Figure 3:
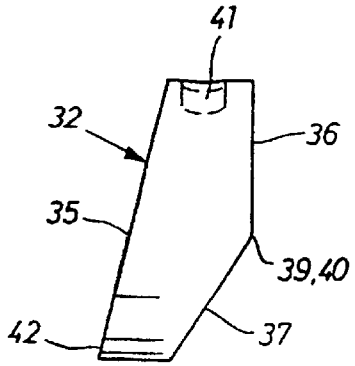
FIG. 3 shows a side view of the thrust element of the manually operable release mechanism.

In the passageway 18, there is arranged a piston rod 14 locking device 21 comprising a tubular conical clamping element 22 which is axially locked relative to the end wall 12 and arranged to frictionally engage the piston rod 14. An activating member 23 in the shape of an annular piston surrounds the clamping element 22 and is axially displaceable relative to the end wall 12 between a clamping element 22 activating position and a clamping element 22 releasing position. The activating member 23 is continuously biassed in the direction of the clamping element 22 activating position by a number of springs 24 one of which is illustrated in FIGS. 1 and 2.

The end wall 12 is formed with an internal cylinder portion 26 in which the activating member 23 is sealingly guided. The activating member 23 is formed with a tubular neck portion 27 which is sealingly guided in a narrowed part 28 of the passageway 18. Pressure medium can reach the cylinder portion 26 via a control port 29 in order to pressurize and displace the activating member 23 in the direction of its release position. The control port 29 communicates with the non-illustrated control circuit, and is arranged to be supplied with pressure medium as soon as either one of the two communication ports 16,17 is pressurized. Alternatively, the pressure medium supply to the control port 29 may be controlled separately for obtaining piston rod braking and/or locking functions.

For reducing the frictional resistance between the activating member 23 and the clamping element 22, there is provided a rectilinear ball bearing 31 therebetween.

Since the piston rod locking device 21 is continuously maintained in its locking position by the bias springs 24, i.e. as long as no pressure medium is supplied via the control port 29 to lift off the spring bias force from the activating member 23, it is not possible to move the piston rod 14 and the connected object manually or otherwise if so required.

This is not only an annoying but sometimes a serious problem, because if for some reason the medium pressure fails the object, for instance a door, can not be moved manually, which might be hazardous to people and equipment.

Figure 4:
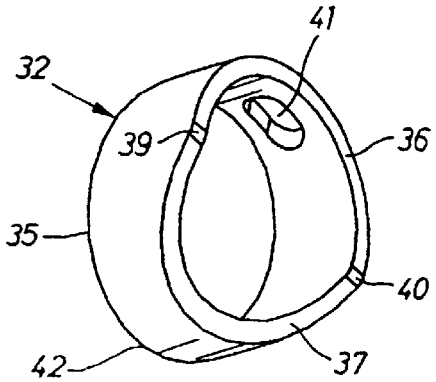
FIG. 4 shows a perspective view of the thrust element in FIG. 3.

According to the invention, this problem is avoided by providing a manually operable release mechanism including tubular thrust element 32 which is movable in the end wall 12 between a rest position and an activating member 23 releasing position, and a maneuver spindle 33 rotatively supported in the end wall 12 about an axis Y perpendicular to the passageway 18 and the piston rod 14. The thrust element 32 is located around a piston rod bushing 34 and has a larger diameter so as to be pivotal in the axial direction of the piston rod 14. The thrust element 32 consists of a piece of tubing which has an inclined rear, end surface 35, a right angle front surface 36 and a bevelled forward part 37, and at the meeting of the bevelled part 37 and the right angle front surface 36 there are formed two diametrically opposite contact or abutment points 39,40 which are intended to engage the activating. member 23. The abutment points 39,40 are located at about half the diameter of the thrust element 32. See FIG. 4.

Diametrically opposite the bevelled part 37, the thrust element 32 is formed with a lateral opening 41 defining a cam surface for exerting a maneuvering force on the element 32 as the latter is to be pivoted about a support point 42 located on the rear end surface 35, diametrically opposite the opening 41. This support point 42 is axially supported against an adjustable set screw 43 mounted in an axially extending threaded bore 44 in the end wall 12. By adjusting the set screw 43, it is possible to compensate for the inevitable spreading of the manufacturing tolerances and set a correct rest position clearance between the thrust element abutment points 39,40 and the activating member 23.

Figure 5:
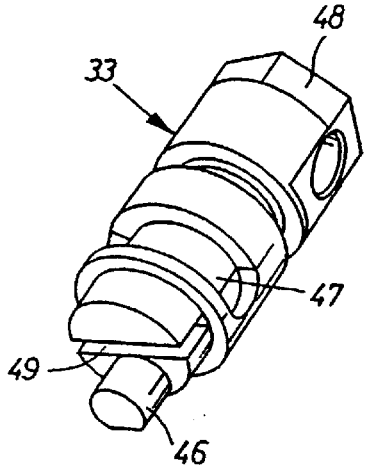
FIG. 5 shows a perspective view of the maneuver spindle in FIG. 1.

The maneuver spindle 33 is rotatively supported in a bore 45 defined by a sleeve 38 mounted in the end wall 12. At its inner end, the maneuver spindle 33 is formed with an excentrically disposed cam pin 46 for co-operation with the cam opening 41 in the thrust element 32, and at its outer end the spindle 33 is provided with a grip means 48 for engagement of a tool or other implement for accomplishing a manual rotation of the spindle 33. The spindle 33 is also formed with a part-circumferential groove 47 which is intended to co-operate with a stop screw (not shown) to limit the rotational movement of the spindle 33 to a desired angle. See FIG. 5.

Figure 6:
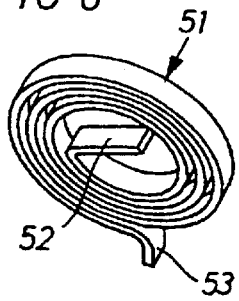
FIG. 6 shows a torsion spring for the manuever spindle.

Moreover, the manuever spindle 32 is formed at its inner end with a diametrically extending slot 49 for engagement with a clock type torsion spring 51. See FIG. 6. This spring 51 is arranged to exert a rotational bias force on the maneuver spindle 33 in a direction where the thrust element 32 occupies its rest position. For engagement with the slot 49 in the maneuver spindle 33, the spring 51 is formed with a diametrically extending inner end portion 52. At its outer end, the spring 51 is formed with a radially directed end portion 53 to be locked relative to the end wall 12.

As described above, the piston 13 and piston rod 14 are locked by the clamping element 22 as the activating member 23 is biassed into engagement therewith by the springs 24. This condition will prevail as long as pressure medium is not supplied via the control port 29 to accomplish a retraction of the activating member 23 against the force of the springs 24. However, if pressure medium for some reason is not available and the object connected to the piston rod 14 has to be moved, the maneuver spindle 33 is operable by a tool or implement to accomplish a movement of the thrust element 32 and the activating member 23.

In particular, at rotation of the maneuver spindle 33 the cam pin 46 co-operates with the cam surface defined by the opening 41 to make the thrust element 32 pivot in relation to its support point 42 and the projection 43 in the passageway 18. During this movement, the thrust element 32 engages via its abutment points 39,40 the activating member 23 and urges the latter axially against the load of the springs 24, whereby the engagement between the activating member 23 and the clamping element 22 is interrupted as is the locking engagement between the clamping element 22 and the piston rod 14.

Due to the limited rotational movement of the spindle 33, the cam pin 46 will occupy an end position as the lock device is fully released which means that the engagement point between the cam surfaces on pin 46 and in opening 41 is located on a straight line with the rotation axis of the spindle 33 which is parallel with the load direction of the springs 24. This means that the spring load does not result in a rotational force on the spindle 33 and that the spindle 33 will remain in its locking device release position as long as the spring force prevails.

However, as soon as pressure medium is supplied via the control port 29, the radial force on the cam pin 46 will cease and the spindle 33 will be returned to its inactive position by the torsion spring 51. It is of course possible to turn the spindle 33 back to its inactive position by applying a tool or other implement to the grip means 48.

By the difference in distance between the support point 42 and the cam surface opening 41 on one hand, and the distance between the abutment points 39,40 and the cam surface opening 41 on the other hand, there is obtained an amplification of the force transferred via the cam surfaces 46,41 and the force exerted by the abutment points 39,40 on the activating member 23. This in combination with a small distance between the rotation axis of the maneuver spindle 33 and the cam surface on the cam pin 46 results in a relatively low operating force needed to release the locking device 21.

What is claimed is:

1. Pressure medium activated piston-cylinder device, comprising a cylinder (10) with two opposite end walls (11,12) provided with pressure medium communication ports (16,17), a piston (13) movably guided in said cylinder (10) and connected to a piston rod (14) which extends out of said cylinder (10) through a sealed-off passageway (18) in a first one (12) of said end walls (11,12), a piston rod locking device (21) located in said passageway (18) and including at least one clamping element (22) axially locked relative to said first end wall (12) and arranged to frictionally engage said piston rod (14), and an activating member (23) continuously spring biassed toward a clamping element (22) activating position and shiftable by pressure medium toward a release position against said spring bias force, characterized in that said piston rod locking device (21) comprises a manually operable release mechanism which includes a thrust element (32) movably supported in said first end wall (12) between a rest position and an activating member (23) releasing position, a maneuver spindle (33) rotatably supported in said first end wall (12) and having a maneuverable end portion (48) extending outside said first end wall (12), a first cam surface (41) provided on said thrust element (32) and a second cam surface (46) provided on said maneuver spindle (33), said first cam surface (41) being engaged by said second cam surface (46) for accomplishing movement of said thrust element (32) between said rest position and said activating member (23) releasing position as said maneuver spindle (33) is rotated.

2. Piston-cylinder device according to claim 1, wherein said thrust element (32) is tubular in shape and located substantially coaxially with said piston rod (14), said thrust element (32) being pivotal in the axial direction of said passageway (18) about a support point (42) located on the outer circumference of said thrust element (32) and said first cam surface (41) is located diametrically opposite said support point (42), wherein rotation of said maneuver spindle (33) causes said thrust element (32) to pivot about said support point (42) between said rest position and said activating member (23) releasing position.

3. Piston-cylinder device according to claim 2, wherein said thrust element (32) has two each other diametrically opposite and axially directed abutment points (39,40) for engagement with said activating member (23), said abutment points (39,40) are both disposed at an angular distance of about 90 degree from said support point (42) as well as from said first cam surface (41).

4. Piston-cylinder device according to anyone of claims 1–3, wherein said maneuver spindle (33) is rotative about an axis extending perpendicularly to said passageway (18).

5. Piston-cylinder device according to claim 4, wherein in said activating member (23) releasing position of said thrust element (32) said first and second cam surfaces (41,46) are arranged to engage each other in a point axially in line with the rotation axis (Y) of said maneuver spindle (33), whereby said spring bias force acting on said activating member (23) is unable to exert a rotational force on said maneuver spindle (33), and a torsion spring (51) is connected between said maneuver spindle (33) and said first end wall (12) so as to exert a rotational force on said maneuver spindle (33) in the direction of said thrust element (32) rest position.

6. Piston-cylinder device according to claim 5, wherein said torsion spring (51) comprises a spiral type clock spring.

* * * * *